United States Patent [19]

Tumber

[11] Patent Number: 4,567,870

[45] Date of Patent: Feb. 4, 1986

[54] GOVERNOR SYSTEM

[75] Inventor: Brian W. Tumber, Greenford, England

[73] Assignee: Lucas Industries Limited, Birmingham, England

[21] Appl. No.: 310,994

[22] Filed: Oct. 13, 1981

[30] Foreign Application Priority Data

Dec. 31, 1980 [GB] United Kingdom ..... 8041544

[51] Int. Cl.[4] ..... F02M 39/00

[52] U.S. Cl. ..... 123/373; 123/370; 123/364; 123/365

[58] Field of Search ..... 123/368, 370, 371, 373, 123/364, 365

[56] References Cited

U.S. PATENT DOCUMENTS

| | | | |
|---|---|---|---|
| 3,672,385 | 6/1972 | Matzen | 123/373 |
| 4,176,642 | 12/1979 | Shipinski | 123/373 |
| 4,368,706 | 1/1983 | Yasuhara | 123/371 |

FOREIGN PATENT DOCUMENTS

| | | | |
|---|---|---|---|
| 2803323 | 8/1978 | Fed. Rep. of Germany | 123/368 |
| 603761 | 4/1978 | U.S.S.R. | 123/373 |

*Primary Examiner*—Carl Stuart Miller

[57] ABSTRACT

A governor system for controlling the setting of a fuel control member of a fuel injection pump includes a manually operable member, a connecting device connecting said members, the connecting device being such as to allow movement of the fuel control member independently of the manually operable member. The system includes a pivot lever upon which acts a speed responsive device which moves the lever in opposition to the force exerted by resilient means in the middle speed range of the associated engine. The lever is connected to the fuel control member through a dash-pot device which acts in the middle speed range to adjust the setting of the fuel control member if there is a sudden change of engine speed. A high speed spring and an idling spring are also provided to provide a normal two speed governor action.

12 Claims, 6 Drawing Figures

GOVERNOR SYSTEM

This invention relates to a governor system for controlling the setting of a fuel quantity control member of a fuel injection pump of the kind intended to supply fuel to a vehicle compression ignition engine, the system comprising a manually operable member connected in use to the throttle pedal of the vehicle, an engine speed responsive device, an idling spring, a maximum speed spring and linkage inter-connecting said components whereby the engine idling and the maximum speeds are controlled by the speed responsive device and the fuel supply to the engine intermediate these speeds is controlled directly by the operator utilizing the throttle pedal.

Such a system is known in the art as a two speed governor system and is widely used in road vehicles powered by compression ignition engines. In some types of vehicle a problem is encountered in a portion of the intermediate speed range, the problem manifesting itself in slight variations of engine speed at a frequency of between 4 and 6 Hz, without any movement on the part of the operator, of the throttle pedal. The reason for the variation in engine speed is not fully understood and it is not clear whether the reason lies within the governor system or in the engine installation.

In order to minimise the variation of speed in the intermediate range it is proposed to subject the fuel quantity control member to a force generated by the speed responsive device so that the control member is moved in the direction to counteract the change of speed.

According to the invention a governor system of the kind specified comprises resilient means which is stressed by said engine speed responsive device in the intermediate speed range, the apparatus including a member which is moved in response to a change of engine speed in the intermediate speed range, and dash-pot means coupling said member to said fuel quantity control member whereby sudden changes of speed in the intermediate speed range, result in corrective movement of the fuel quantity control member.

BRIEF DESCRIPTION OF THE DRAWINGS

Referring to FIG. 1 of the drawings there is illustrated at 10, a lever which is connected to the fuel quantity control member of the injection pump, the quantity control member conveniently being a throttle which controls the flow of fuel to the injection pump during the filling periods thereof. The lever 10 is pivoted about a pivot 11 and is movable in the clockwise direction to reduce the amount of fuel supplied by the injection pump to the engine.

Figure 1:
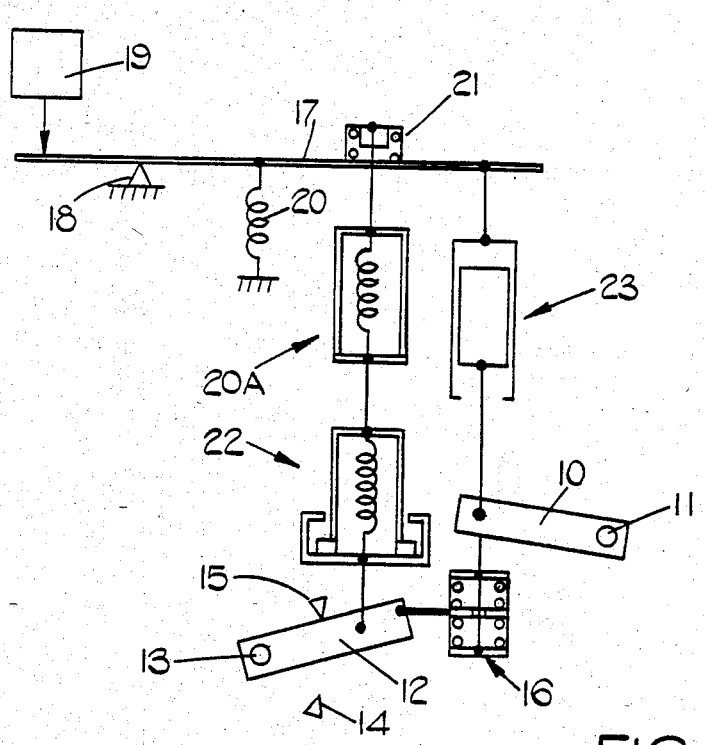
FIG. 1 shows a first embodiment of the disclosed invention.

Also provided is a lever 12 which is pivoted at 13, and which is connected to the throttle pedal of the vehicle.

The lever 12 is movable in the clockwise direction to effect an increase in the fuel supply to the engine, the extent of movement in the clockwise direction being controlled by a stop 14 which constitutes the maximum fuel stop and the extent of movement in the anti-clockwise direction is limited by a stop 15 which constitutes the idling stop.

The levers 10 and 12 are inter-connected through a spring loaded connecting device 16. The device 16 as shown, includes a pair of springs which can yield to permit in particular, movement of the lever 10 under the action of other forces.

The governor system also includes a pivotal lever 17 which is pivoted at 18 and which at one end, is connected to a speed responsive device 19 which may for example comprise a plurality of governor weights which are mounted in a cage driven at a speed which is proportional to the speed of the associated engine. The speed responsive device exerts a force on the lever 17 to pivot the lever in the anti-clockwise direction about its pivot 18.

The lever 17 is biassed in the clockwise direction by an idling spring 20 one end of which is coupled to the lever 17 and the other end of which is coupled to the housing of the governor.

The system includes a maximum speed spring which is indicated at 20A and which is a pre-stressed spring so that it expands only when the maximum engine speed is approached. The spring 20A is coupled to the lever 17 through a relatively light spring 21 and to the lever 12 through resilient means 22. The resilient means 22 comprises a spring which expands only in the portion of the intermediate speed range of the engine in which the speed variation takes place. Finally dash-pot means in the form of a dash-pot 23, is connected between the lever 17 and the lever 10. The dash-pot has a limited stroke and the piston thereof can engage the opposite end walls of the cylinder under certain operating conditions which will be described.

The operation of the system will now be described starting first with the various parts in the position shown in FIG. 1. In this position the lever 12 is set to the idling position and the lever 10 is set to a low fuel position by the action of a spring in the connecting device 16. The speed responsive device 19 is shown to be exerting a force upon the lever 17 which moves the lever against the action of the idling spring 20 and also the light spring 21. In this position therefore it can be assumed that the engine speed is slightly higher than idling speed. Because of the setting of the link 10 the engine speed will fall and the force exerted by the speed responsive device 19 will also fall so that the lever 17 will pivot in the clockwise direction under the action of the springs 20 and 21. Such movement will cause the piston of the dash-pot to contact the end of the cylinder and will effect movement of the lever 10 in a direction to increase the amount of fuel supplied to the engine. This movement will of course take place against the action of one of the springs in the connecting device 16. As the engine speed rises so the force exerted by the speed responsive device 19 will increase and the lever 17 will tend to move in the anti-clockwise direction thereby reducing the amount of fuel supplied to the engine. This process is repeated and the idling speed of the engine is controlled.

If now the lever 12 is set to the maximum fuel position, the lever 10 will be moved to substantially increase the amount of fuel supplied to the engine through the action of the connecting device 16. In addition, the lever 17 will pivot in the clockwise direction under the action of the force transmitted to it through the spring 20A, the spring 21 being fully collapsed. The resilient means 22 will also be fully extended. As the engine speed increases, the force exerted by the device 19 will gradually increase but no pivotal movement of the lever 17 will take place until the engine speed approaches its maximum safe speed. As the maximum safe speed is approached the force exerted by the speed responsive device 19 will increase to a value such that the maximum speed spring 20A starts to extend and when this occurs the lever 17 will pivot and the piston of the dash-pot device will be engaged by the end of the cylinder to cause movement of the lever 10 in a direction to reduce the amount of fuel supplied to the engine. During this movement a spring in the connecting device 16 will collapse. It is possible if the rate of rise of engine speed is high, that the dash-pot 23 will effect some movement of the link 10 before its piston engages the end of the cylinder.

Considering now the situation in the intermediate speed range. In this range the maximum speed spring being pre-stressed, assumes a fixed length and the piston of the dash-pot a central position. The amount of fuel supplied to the engine is controlled by the driver through the intermediary of the lever 12, the device 16 and the lever 10. If the lever 12 is moved to vary the amount of fuel then the device 16 will effect movement of the lever 10. When the speed lies within the aforesaid portion of the intermediate speed range the resilient means 22 is able to extend or contract as the speed varies and as the position of the lever 12 is altered. The force exerted by the speed responsive device on the lever 17 is therefore balanced by the restoring force exerted by the resilient means 22. The lever 17 therefore will move in accordance with the change of engine speed. If the change of engine speed is due to some action on the part of the driver, then the dash-pot will have little or no effect upon the setting of the lever 10. If on the other hand there is a sudden change in the engine speed which is not as a result of movement of the lever 12, then the movement of the lever 17 will be imparted to the lever 10 through the action of the dash-pot. For example, if the engine speed suddenly rises the lever 17 will pivot in the anti-clockwise direction and will through the dash-pot, effect movement of the lever 10 in the clockwise direction to counteract the change in speed. Such movement will of course take place against the action of one of the springs in the connecting device 16 and when the dash-pot action ceases, the position of the lever 10 will be restored by the action of the spring. Conversely if the speed suddenly falls, the other spring in the connecting device will be collapsed and the lever 10 will move in the opposite direction increase the amount of fuel supplied to the engine to counteract the change in engine speed.

Figure 2:
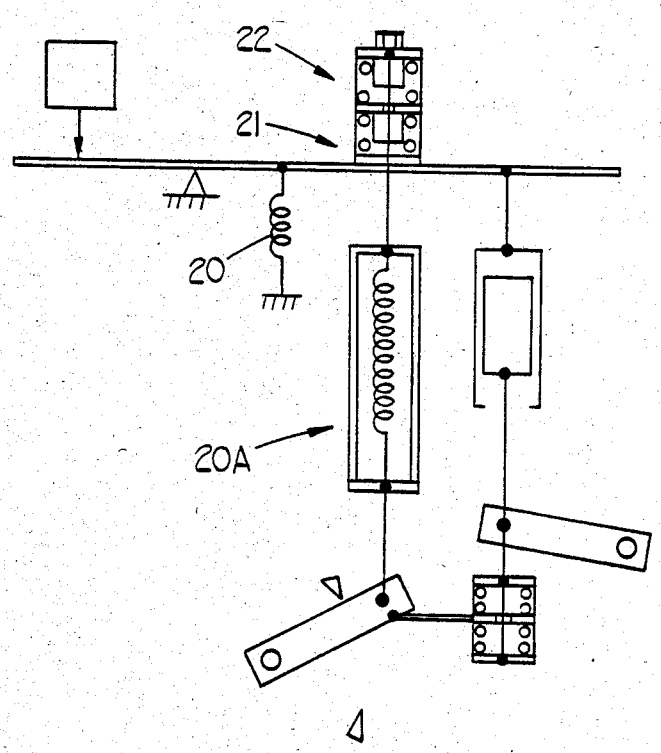
FIG. 2 shows a second embodiment of the disclosed invention.

The arrangement which is shown in FIG. 2 is basically the same as the arrangement of FIG. 1. The difference is that the resilient means 22 is positioned between the maximum speed spring 20A and the spring 21 and it comprises a compression spring rather than a tension spring.

Figure 3:
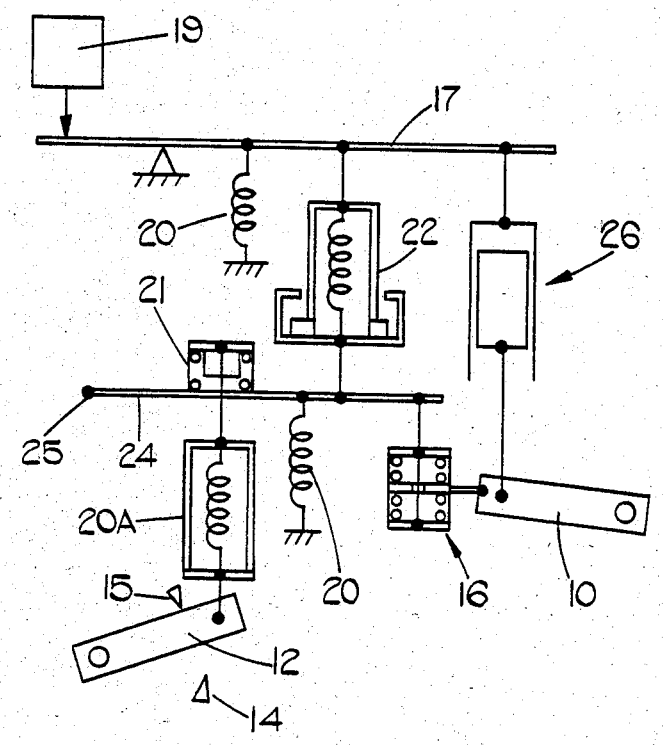
FIG. 3 shows a third embodiment of the disclosed invention.

Turning now to the arrangement which is shown in FIG. 3, the components which perform the same function as those in FIG. 1, are assigned the same reference numerals. In the example of FIG. 3, it will be seen that an additional lever 24 is provided this being pivoted at 25. The lever 24 is connected to the lever 10 through the connecting device 16 and it is connected to the lever 12 through the maximum speed spring 20A and the relatively light spring 21. In addition, the lever 24 is connected to the lever 17 through the resilient means 22. The idling spring 20 is shown connected to the lever 17 but if so desired, it can be connected to the lever 24. The dash-pot device now referenced 26, is constructed so that its piston does not under any conditions of operation, contact the end walls of the cylinder.

The operation of the arrangement shown in FIG. 3 is substantially identical with the earlier arrangements described. When the lever 12 is set in the idling position as shown, movement of the lever 17 with changes in engine speed, is transmitted to the lever 24 through the resilient means 22 and from the lever 24 to the lever 10 through the connecting device 16. Any correction of the fuel supply is therefore effected by way of the lever 24 and hence the idling spring 20 can be associated with the lever 17 or the lever 24. Control of the maximum speed of the engine is effected in substantially the same manner but in this case it is the spring 20A which provides the restoring force for the force which is exerted by the speed responsive device. Again movement of the lever 24 is transmitted to the lever 10 by way of the connecting device 16. In the intermediate speed range the position of the lever 24 is determined by the position of the lever 12 and so also is the position of the lever 10. The lever 17 can however move in response to changes in engine speed, the restoring force applied to the lever 17 being provided by the resilient means 22. If there is a rapid change of engine speed the resulting movement of the lever 17 is transmitted to the lever 10 through the dash-pot 26. As in the previous examples, the movement of the lever 10 by the dash-pot will result in collapse of one of the springs in the connecting device 16.

In the case where in the example of FIG. 3, the spring 20 is connected to the lever 24, the tension spring shown could be replaced by a leaf spring acting on the lever 24 or a portion of the lever 24 adjacent the pivot 25 could be formed as a leaf spring.

For one type of engine having an idling speed of approximately 800 R.P.M. and a maximum speed of approximately 5500 R.P.M. the portion of the intermediate speed range in which the speed variation occurs is between 1500 and 2500 R.P.M. The resilient means 22 is therefore arranged to extend and contract in this range of speeds.

Figure 4:
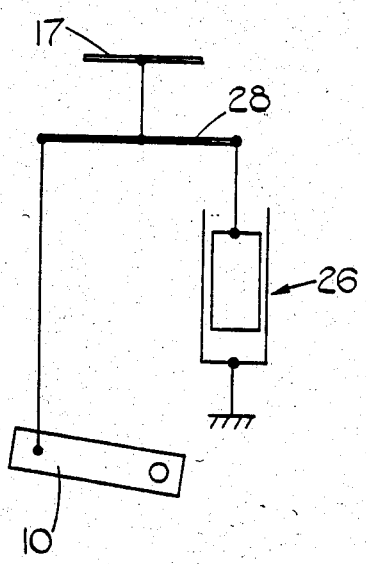
FIG. 4 shows a first modification of the dashpot used in the embodiment of FIG. 3.
Figure 5:
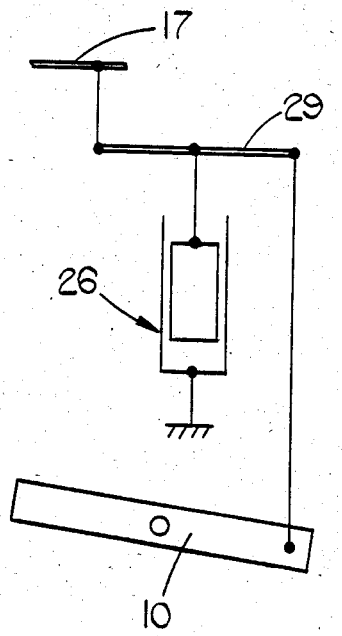
FIG. 5 shows a second modification of the dash-pot used in the embodiment of FIG. 3

FIGS. 4 and 5 illustrate modifications to the dash-pot means to FIG. 3. In FIGS. 4 and 5 the dash-pot 26 has its cylinder connected to a fixed point. The piston of the dash-pot is connected to a further lever in the case of the example of FIG. 4, referenced 28 and in the case of the example of FIG. 5, referenced 29. In the example of FIG. 4 the piston is connected to one end of the lever 28 and the other end is connected to the lever 10. Intermediate its ends the lever is pivotally connected to the lever 17. In the example of FIG. 5 the lever 17 is connected to the other end of the lever 29 and this piston of the dash-pot is connected to a pivot intermediate the ends of the lever. The operation is substantially the same in each case. In the event of a sudden movement of the lever 17 the pivot attached to the dash-pot piston acts as the fulcrum and the lever 10 is moved to adjust the fuel supply. In the case when the movement of the lever 17 is gradual, the dash-pot collapses to accommodate the movement so that no movement is imparted to the lever 10. It will be noted that in the example shown in FIG. 5, the lever 10 has an extension which is connected to the lever 29. This is to ensure that the lever 10 moves in the correct direction to compensate for the speed change.

The provision of the levers 28 and 29 reduces the inertia of the system. Moreover the levers enable the dash-pot to be positioned at a more convenient position.

Figure 6:
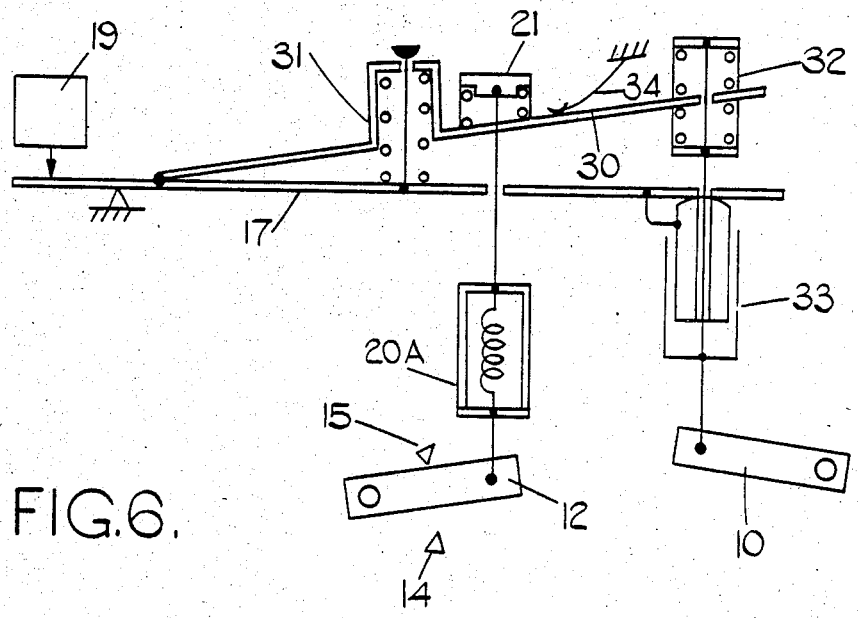
FIG. 6 shows a fourth embodiment of the disclosed invention.

Turning now to FIG. 6, parts which have the same construction and function as the parts in the example of FIG. 3 are assigned the same reference numeral. In this case it will be seen that the lever which is the equivalent of the lever 24 is pivotally mounted upon the lever 17. This is for convenience only and has no bearing up the operation of the system. The resilient means 31 takes the form of a pre-stressed spring and it is the equivalent of the resilient means 22. The lever 10 is connected to the device 32 this being the equivalent of the device 16 and the connection passes through the dash-pot 33. The dash-pot has its piston connected to the lever 17 and its cylinder connected to the lever 10. The connection to the device 32 is through the piston of the dash-pot, this being provided with a cylindrical aperture, the connection to the device 32 being in the form of a rod which makes a fluid seal with the wall of the aperture so as not to impair the dash-pot action. FIG. 6 also shows the use of a leaf spring 34 as the idling spring this being the equivalent of the spring 20.

I claim:

1. An improvement in a two-speed governor system for controlling the setting of a fuel quantity control member of a fuel injection pump of the kind intended to supply fuel to a vehicle compression ignition engine, the system including a manually operable member connected to a throttle pedal of the engine, an engine speed responsive device, an idling spring, a maximum speed spring and interconnecting means for connecting the fuel quantity control member, the engine speed responsive device, the idling spring and the maximum speed spring whereby engine idling and engine maximum speed are controlled by the speed responsive device, the improvement comprising:

means for controlling engine speed variation in an intermediate range of engine speeds which lies between engine idling speed and engine maximum speed, said means including coupling means connecting the manually operable member to the fuel quantity control member for controlling the amount of fuel supplied to the engine via the manually operable member, said coupling means and the fuel quantity control member; and connecting means connecting the engine speed responsive device to the fuel quantity control member to effect movement of said fuel quantity control member in said intermediate engine speed range in response to engine speed, said connecting means having means for coupling the speed responsive device to the fuel quantity control member during engine speed-up and forcing the fuel quantity control member in a direction of fuel reduction and for coupling the speed responsive device to the fuel quantity control member during engine slowdown and forcing the fuel quantity control member in a direction of fuel increase, said coupling means and said connecting means being separate from each other whereby the fuel quantity control member is moved in a direction to counteract engine speed changes in said intermediate engine speed range and engine speed is controlled both manually and automatically in said intermediate engine speed range.

2. A governor system for controlling the setting of a fuel quantity control member of a fuel injection pump of the kind intended to supply fuel to a vehicle compression ignition engine, the system comprising a manually operable member connected in use to the throttle pedal of the vehicle, an engine speed responsive device, an idling spring, a maximum speed spring and linkage interconnecting said components whereby the engine idling and the maximum speeds are controlled by the speed responsive device and the fuel supply to the engine intermediate these speeds is controlled directly by the operator utilizing the throttle pedal, resilient means which is stressed by said engine speed responsive device in the intermediate speed range, the apparatus including a pivotal lever forming part of said linkage and which is acted upon by said speed responsive device in response to a change of engine speed in the intermediate speed range to effect movement of the lever in one direction with increase of speed, said resilient means and said maximum speed spring being connected in series between said manually operable member and said lever and connected to said lever through a light spring having limited deflection, said idling spring being connected to said lever, and dash-pot means coupling said lever to said fuel quantity control member whereby sudden changes of speed in the intermediate speed range, result in corrective movement of the fuel quantity control member, said dash-pot means including a dash-pot and a further lever one end of which is pivotally connected to said first mentioned lever, said dash-pot having one component connected to a fixed point, the other component of said dash-pot and said quantity control member being pivotally connected to spaced points on said further lever respectively.

3. A governor system for controlling the setting of a fuel quantity control member of a fuel injection pump of the kind intended to supply fuel to a vehicle compression ignition engine, the system comprising a manually operable member connected in use to the throttle pedal of the vehicle, an engine speed responsive device, an idling spring, a maximum speed spring and linkage interconnecting said components whereby the engine idling and the maximum speeds are controlled by the speed responsive device and the fuel supply to the engine intermediate these speeds is controlled directly by the operator utilizing the throttle pedal, resilient means which is stressed by said engine speed responsive device in the intermediate speed range, the apparatus including a pivotal lever forming part of said linkage and which is acted upon by said speed responsive device in response to a change of engine speed in the intermediate speed range to effect movement of the lever in one direction with increase of speed, said resilient means and said maximum speed spring being connected in series between said manually operable member and said lever, a further pivotal lever connected to the junction of said resilient means and said maximum speed spring, said maximum speed spring being connected between said further lever and said manually operable lever, a connecting device interposed between said further lever and the fuel quantity control member, said connecting device acting to transmit movement of said further lever directly to said fuel quantity control member while allowing independent movement of said fuel quantity control member, and dash-pot means coupling said first mentioned lever to said fuel quantity control member whereby sudden changes of speed in the intermediate speed range, result in corrective movement of the fuel quantity control member.

4. A system according to claim 1 in which said coupling means forms part of said interconnecting means and comprises a pivotal lever which is acted upon by said speed responsive means to effect movement of the lever in one direction with increase of speed, said resilient means being operatively connected to said lever.

5. A system according to claim 4 in which said resilient means and said maximum speed spring are connected in series between said manually operable member and said lever.

6. A system according to claim 1 in which said coupling means comprises a pair of springs one or the other of which can yield to allow movement of the fuel control lever.

7. A system according to claim 5, in which the idling spring is connected to said lever, and in which said high speed spring and said resilient means are connected to said lever through a light spring having limited deflection.

8. A system according to any one of the preceding claims, in which said dash-pot means includes a dash-pot having a limited stroke.

9. A system according to claim 3 in which said idling spring is connected to one of said levers.

10. A system according to claim 9 including a light spring having limited deflection connected between said high speed spring and said further lever.

11. A system according to claim 1 in which said resilient means has limited deflection.

12. A system according to claim 3 in which said further lever is pivotally mounted on said first mentioned lever, said resilient means comprising a coiled compression spring acting between said levers.

* * * * *